US011577298B2

(12) United States Patent
Kiriaki et al.

(10) Patent No.: US 11,577,298 B2
(45) Date of Patent: Feb. 14, 2023

(54) FLOATING CUTTER UNIT AND TRIMMING PRESS PROCESSING DEVICE

(71) Applicant: OILES CORPORATION, Tokyo (JP)

(72) Inventors: Hideki Kiriaki, Fujisawa (JP); Junichi Tanahashi, Fujisawa (JP); Satoshi Abe, Fujisawa (JP)

(73) Assignee: OILES CORPORATION, Tokyo (JP)

( * ) Notice: Subject to any disclaimer, the term of this patent is extended or adjusted under 35 U.S.C. 154(b) by 0 days.

(21) Appl. No.: 16/971,534

(22) PCT Filed: Feb. 13, 2019

(86) PCT No.: PCT/JP2019/005173
§ 371 (c)(1),
(2) Date: Aug. 20, 2020

(87) PCT Pub. No.: WO2019/163614
PCT Pub. Date: Aug. 29, 2019

(65) Prior Publication Data

US 2021/0078065 A1 Mar. 18, 2021

(30) Foreign Application Priority Data

Feb. 22, 2018 (JP) ..... JP2018-030166

(51) Int. Cl.
*B21D 37/12* (2006.01)
*B21D 28/14* (2006.01)
(Continued)

(52) U.S. Cl.
CPC ..... *B21D 37/12* (2013.01); *B21D 28/14* (2013.01); *B21D 43/003* (2013.01); *B21D 45/02* (2013.01)

(58) Field of Classification Search
CPC ..... B21D 28/14; B21D 28/26; B21D 28/28; B21D 28/246; B21D 28/243; B21D 28/24; B21D 28/34
See application file for complete search history.

(56) References Cited

U.S. PATENT DOCUMENTS

2010/0139355 A1 6/2010 Aramizu et al.
2010/0199739 A1* 8/2010 Thaddaeus ..... B21D 24/16 72/328

FOREIGN PATENT DOCUMENTS

CN 200951486 Y 9/2007
CN 101767143 A 7/2010
(Continued)

OTHER PUBLICATIONS

Fujii, Translation of JPH1029020 (Year: 1998).*
(Continued)

*Primary Examiner* — Adam J Eiseman
*Assistant Examiner* — Bobby Yeonjin Kim
(74) *Attorney, Agent, or Firm* — Nixon & Vanderhye P.C.

(57) ABSTRACT

The present invention increases the positional accuracy of a floating cutter unit with respect to a press upper die for main trimming. A floating cutter unit is provided with: a floating cutter for cutting scrap from a plate-shaped material, said floating cutter being attached to and used in a trimming press processing device that cuts scrap from a plate-shaped material along a trim line Tr and that additionally cuts scrap along a scrap cut line Sc; a spring that is brought into contact with the tail end surface of the floating cutter and with a holder set for holding the floating cutter so as to be movable in the direction of an axial center O, and that applies reaction force to the floating cutter; and a guide member that is attached to
(Continued)

the holder set, brought into contact with the floating cutter, and used to guide movement in the direction of the axial center O.

7 Claims, 13 Drawing Sheets

(51) Int. Cl.
*B21D 43/00* (2006.01)
*B21D 45/02* (2006.01)

(56) References Cited

FOREIGN PATENT DOCUMENTS

| | | | | | |
|---|---|---|---|---|---|
| CN | 102962312 | A | | 3/2013 | |
| CN | 103611837 | A | | 3/2014 | |
| CN | 104959735 | A | | 10/2015 | |
| EP | 2 098 311 | A1 | | 9/2009 | |
| EP | 2098 311 | B1 | | 4/2014 | |
| JP | 7-256355 | | | 10/1995 | |
| JP | 10-29020 | | | 2/1998 | |
| JP | H1029020 | | * | 2/1998 | ..... B21D 28/14 |
| JP | 2008-126304 | | | 6/2008 | |
| JP | 2009-262175 | | | 11/2009 | |
| JP | 2012-240109 | | | 12/2012 | |
| JP | 2012240109 | A | * | 12/2012 | |
| JP | 2015169231 | A | * | 9/2015 | |
| WO | 2013/171795 | A1 | | 11/2013 | |

OTHER PUBLICATIONS

International Search Report for PCT/JP2019/005114 dated Apr. 23, 2019, 5 pages.
International Search Report for PCT/JP2019/005173 dated Apr. 23, 2019, 4 pages.
Extended European Search Report dated Oct. 8, 2021 issued in European Application No. 19757245.6 (7 pages).
Extended European Search Report dated Oct. 11, 2021 issued in European Application No. 19757599.6 (7 pages).
Chinese Search Report dated Feb. 8, 2022 in Chinese Application No. 201980014624.X with English translation (5 pages).
Chinese Search Report dated Apr. 7, 2022 issued in Chinese Application No. 201880086201.4 with English translation (4 pages).

* cited by examiner (A)

(B)

FLOATING CUTTER UNIT AND TRIMMING PRESS PROCESSING DEVICE

This application is the U.S. national phase of International Application No. PCT/JP2019/005173 filed Feb. 13, 2019 which designated the U.S. and claims priority to JP Patent Application No. 2018-030166 filed Feb. 22, 2018, the entire contents of each of which are hereby incorporated by reference.

TECHNICAL FIELD

The present invention relates to a floating cutter unit provided with a floating cutter that is used as a sub trimming press upper die of a trimming press processing device.

BACKGROUND ART

Usually, a trimming press processing device that can divide a scrap arising from trimming is provided with trimming press upper and lower dies having cutting teeth for cutting off a scrap other than a product part from a plate material along a trimming line and in addition scrap cutting press upper and lower dies having cutting teeth for dividing the cut-off scrap further along a scrap cut line. Between the trimming press upper and lower dies, the trimming press upper die comprises a main trimming press upper die and a sub trimming press upper die. The main trimming press upper die moves up and down in relation to the trimming press lower die that is stationary, and the sub trimming press upper die moves synchronously or asynchronously with the main trimming press upper die depending on the situations.

The processing process by the trimming press processing device comprises two steps: a trimming processing step (first step), in which the trimming press upper and lower dies cut off the scrap; and a scrap dividing step (second step), in which the scrap cutting press upper and lower dies divide the scrap further.

In the first step, the sub trimming press upper die moves down together with the main trimming press upper die, and holds the plate material between the main trimming press upper die together with the sub trimming press upper die and the trimming press lower die, to cut off the scrap other than the product part from the plate material along a trim line. Thereafter, in the second step, the sub trimming press upper die that further moves down together with the main trimming press upper die comes in contact with the scrap on the scrap cutting press lower die, to press against the scrap with a constant load and maintain that state, and then moves up in relation to the main trimming press upper die. The scrap cutting press upper die moves down together with the main trimming press upper die. When the sub trimming press upper die relatively moves up after cutting-off of the scrap other than the product part, the scrap cutting press upper die continues pressing against the scrap with a constant load, holds the scrap between the scrap cutting press upper die and the scrap press lower die, and divides the scrap along the scrap cut line.

The Patent Literature 1 discloses a floating cutter unit provided with a floating cutter that is used as a sub trimming press upper die.

This floating cutter unit comprises: a floating cutter; a holder set, which holds the floating cutter movably in the axial direction; and a spring, which is in contact with a tail end surface of the floating cutter and gives reaction force to the floating cutter.

The holder set comprises: a cutter holder, in which a through-hole for inserting the floating cutter is formed; a bush, which is fitted in the through-hole of the cutter holder and has an inner peripheral surface that comes in sliding contact with the outer peripheral surface of the floating cutter; and a spring holder, in which a through-hole for inserting the spring is formed coaxially with the through-hole of the cutter holder.

The spring prevents by reaction force the floating cutter from moving up in relation to the main trimming press upper die at the time when the trimming press upper and lower dies cut off a scrap. On the other hand, after cutting-off of the scrap, the spring allows the floating cutter to move up in relation to the main trimming press upper die at the time when the floating cutter comes in contact with the scrap cutting press lower die and is pressed against by the scrap cutting press lower die.

CITATION LIST

Patent Literature

Patent Literature 1: Japanese Unexamined Patent Application Laid-Open No. 2012-240109

SUMMARY OF INVENTION

Technical Problem

In the floating cutter unit described in the Patent Literature 1, the floating cutter, as a sub trimming press upper die, forms a cutting tooth along a trim line together with the main trimming press upper die. Accordingly, in order to finish beautifully the cut surface of a plate material along the trim line, it is desired that the floating cutter unit is moved up and down with a high degree of accuracy in relation to the main trimming press upper die, to increase the positional accuracy of the floating cutter unit in relation to the main trimming press upper die.

The present invention has been made taking the above situation into consideration, and an object of the present invention is to provide a floating cutter and a trimming press processing device that can improve the positional accuracy of a floating cutter unit in relation to a main trimming press upper die.

Solution to Problem

To solve the above problem, in a floating cutter unit of the present invention, a guide member, which is in contact with a floating cutter and guides movement of a floating cutter in the axial direction, is fixed to a holder set that holds the floating cutter movably in the axial direction.

For example, the present invention provides a floating cutter unit used being attached to a trimming press processing device that cuts a scrap from a plate material along a trim line and divide the scrap further along a scrap cut line, comprising:

a floating cutter, which cuts the scrap from the plate material;

a holder set, which holds the floating cutter movably in a direction of an axial center of the floating cutter;

a spring, which is in contact with a tail end surface of the floating cutter so as to give reaction force to the floating cutter; and a guide member, which is fixed to the holder set and is in contact with the floating cutter so as to guide movement of the floating cutter in the direction of the axial center.

Further, the present invention provides a trimming press processing device, comprising:

a trimming press lower die;

a main trimming press upper die, which moves toward the trimming press lower die and cuts off a scrap other than a product part from a plate material between the main trimming press upper die and the trimming press lower die along a trim line;

the above-described floating cutter unit, which moves together with the main trimming press upper die toward the trimming press lower die, and cuts off the scrap from the plate material together with the main trimming press upper die between the trimming press lower die and the floating cutter unit together with the main trimming press upper die;

a scrap cutting press lower die, which is positioned with a space from a cutting edge of the trimming press lower die at a distance corresponding to a plate thickness of the plate material in a direction of moving of the main trimming press upper die; and a scrap cutting press upper die, which moves together with the main trimming press upper die and divides the scrap along a scrap cut line between the scrap cutting press upper die and the scrap cutting press lower die;

wherein, in the floating cutter unit, when the floating cutter that has cut off the scrap is pressed against the scrap cutting lower die, the floating cutter is moved relative in a reverse direction to the direction of moving of the main trimming press upper die against to the holder set by compression of the spring.

Advantageous Effects of Invention

In the floating cutter unit of the present invention, the guide member is fixed to the holder set that holds the floating cutter movably in the axial direction. Thereby, it is possible to increase the positional accuracy of the guide member in relation to the floating cutter, and at the same time it is possible to guide movement of the floating cutter in the axial direction near by the front end of the floating cutter that forms a cutting tooth along the trim line together with the main trimming press upper die. Thus, according to the present invention, it is possible to make the floating cutter unit move up and down with a high degree of accuracy in relation to the main trimming press upper die, and to increase the positional accuracy of the floating cutter unit in relation to the main trimming press upper die.

DESCRIPTION OF EMBODIMENTS

Figure 1:
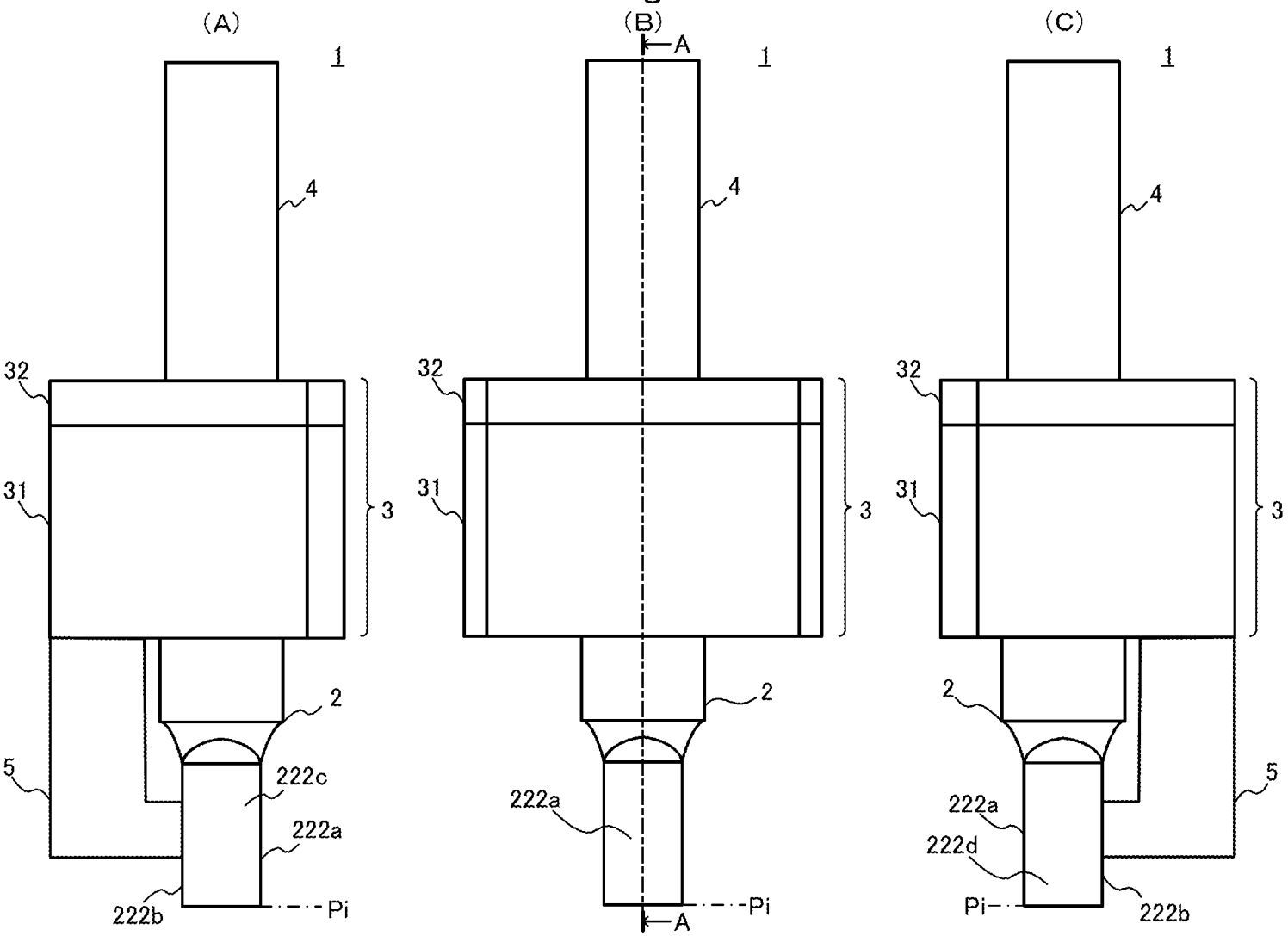
FIGS. 1(A), 1(B), and 1(C) are respectively a left side view, a front view, and a right side view of a floating cutter unit 1 according to one embodiment of the present invention.

In the following, one embodiment of the present invention will be described referring to the drawings.

A floating cutter unit 1 according to the present embodiment is used in a trimming press processing device, being attached to an upper die attachment plate that moves up and down interlocking with a ram when a scrap other than the product part is cut off and separated from a plate material along a trim line Tr and thereafter the scrap is divided along a scrap cut line Sc.

Figure 2:
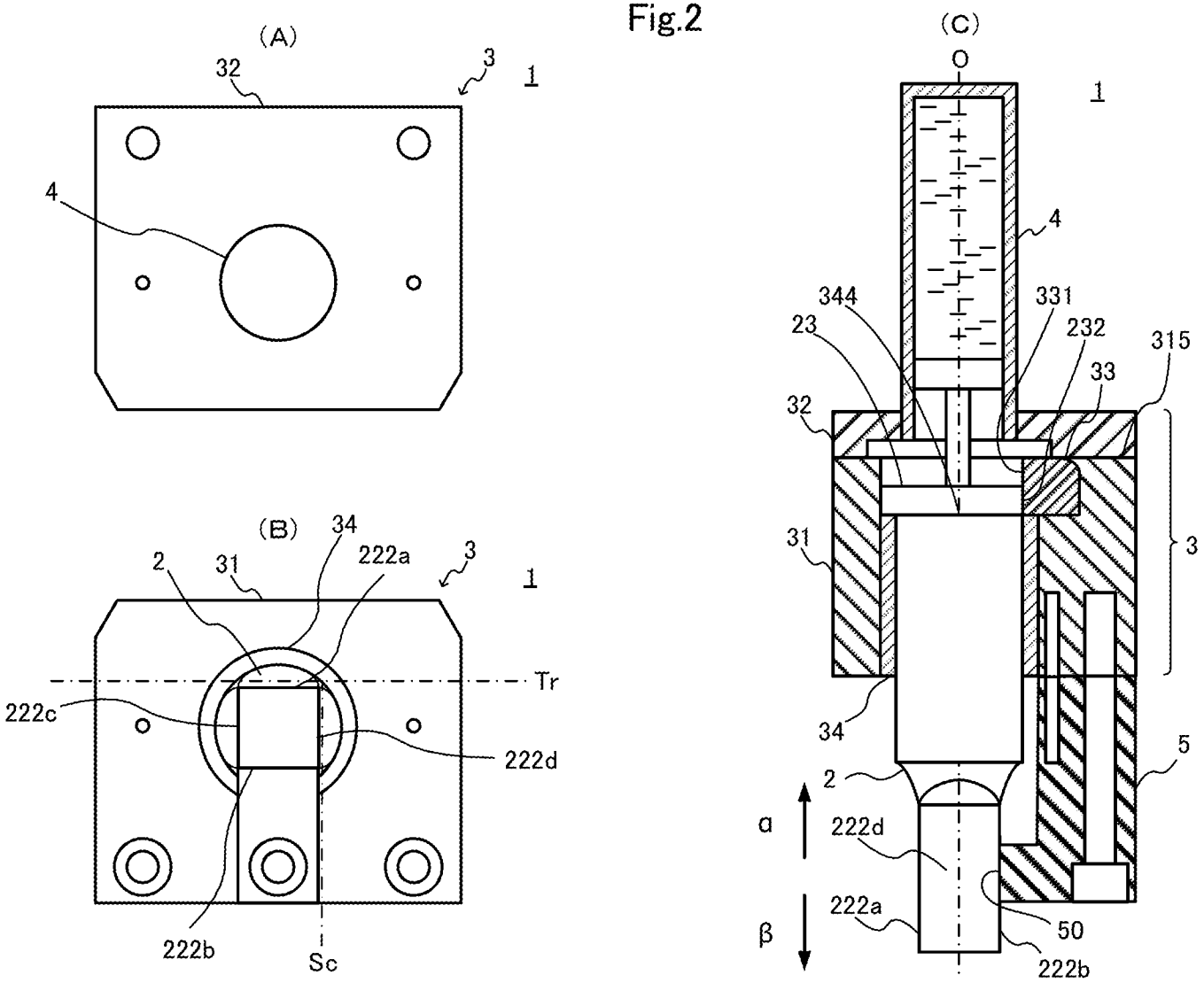
FIGS. 2(A) and 2(B) are respectively a top view and a bottom view of the floating cutter unit 1 according to the one embodiment of the present invention.
FIG. 2(C) is an A-A cross-section view of the floating cutter unit 1 shown in FIG. 1(B)

FIGS. 1(A), 1(B), and 1(C) are respectively a left side view, a front view, and a right side view of the floating cutter unit 1 of the present embodiment. Further, FIGS. 2(A) and 2(B) are respectively a top view and a bottom view of the floating cutter unit 1 of the present embodiment, and FIG. 2(C) is an A-A cross-section view of the floating cutter unit 1 shown in FIG. 1(B).

As shown in the figures, the floating cutter unit 1 of the present embodiment comprises: a floating cutter 2; a holder set 3, which holds the floating cutter 2 movably in the direction of the axial center O ($\alpha$ direction and R direction); a tubular spring 4, which limits upward movement (in the $\alpha$ direction) of the floating cutter 2 in relation to the holder set 3; a guide member 5, which guides movement of the floating cutter 2 in the direction of the axial center O; and, although not shown, fixing bolts for fixing the guide member 5 to the holder set 3 and fixing bolts for fixing the floating cutter unit 1 to the upper die attachment plate of the trimming press processing device.

Further, the holder set 3 comprises: a cutter holder 31, which holds the floating cutter 2 movably in the direction of the axial center O; a spring holder 32, which is superposed on one end surface (a surface on the side of the upper die attachment plate of the trimming press processing device: hereinafter referred to as the upper surface) 315 of the cutter holder 31 on the side of the α direction, so as to hold the spring 4 coaxially with the floating cutter 2 held by the cutter holder 31; a rotation lock 33 for preventing rotation of the floating cutter 2 in relation to the holder set 3; and a cylindrical bush 34, which is fitted into the cutter holder 31 and into which the floating cutter 2 is inserted.

Figure 3:
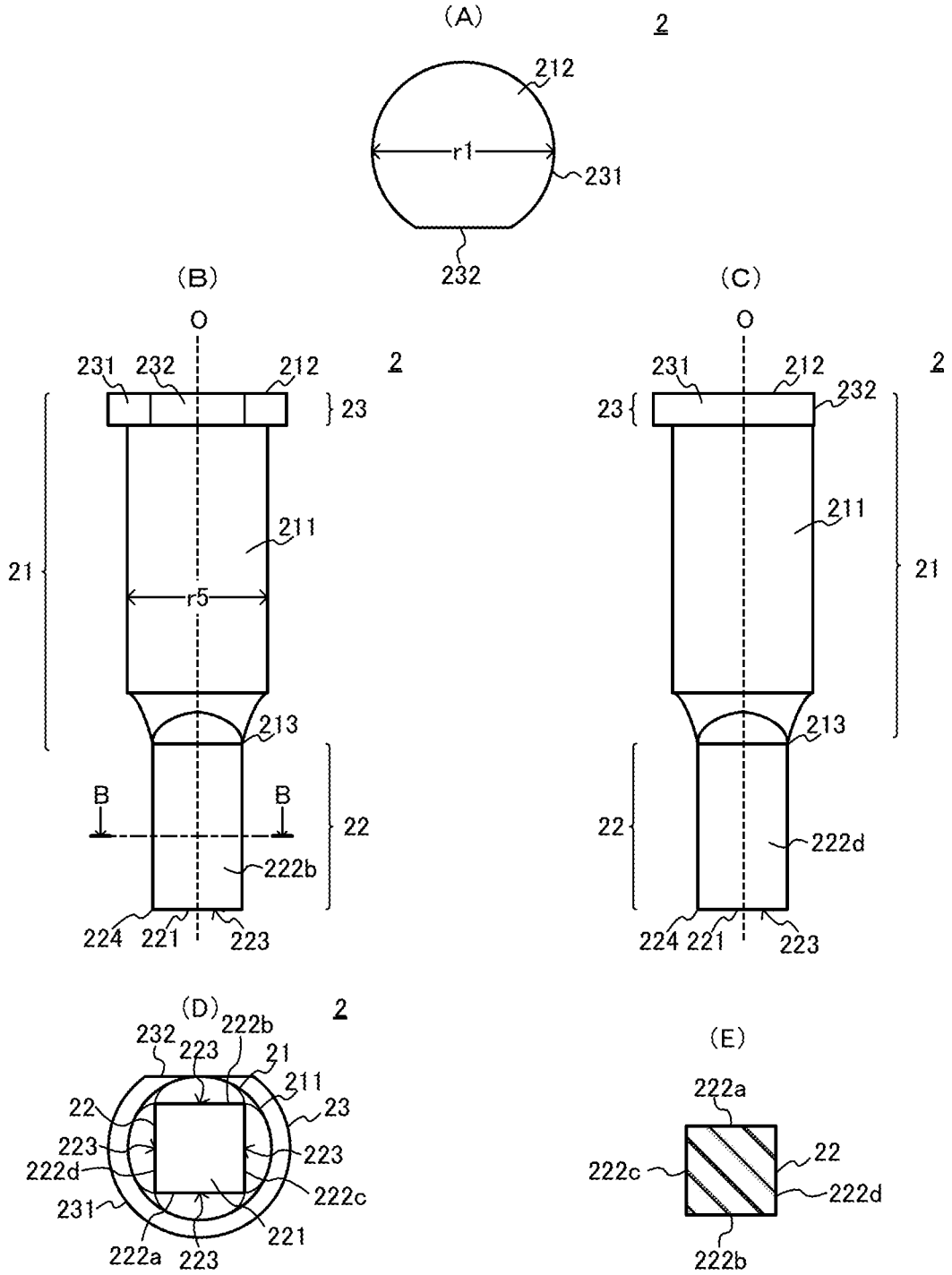
FIGS. 3(A)-3(D) are respectively a top view, a front view, a side view, and a bottom view of a floating cutter 2.
FIG. 3(E) is a B-B cross-section view of the floating cutter 2 shown in FIG. 3(B)

FIGS. 3(A)-3(D) are respectively a top view, a front view, a side view, and a bottom view of the floating cutter 2, and FIG. 3(E) is a B-B cross-section view of the floating cutter 2 shown in FIG. 3(B).

As shown in the figures, the floating cutter 2 comprises: a shank part 21 of a circular cylindrical shape; and a cutting part 22 of a prismatic shape, which is formed integrally with the shank part 21 so as to join to one end 213 of the shank part 21.

In the cutting part 22, cutting edges 223 are formed by intersection lines of a cutting surface 221 as the front end surface on one end 224 of the cutting part 22 and respective cutting surfaces 222*a*-222*d* (hereinafter, also simply referred to as cutting surfaces 222) of the side surfaces.

On the outer circumference of the other end 212 (the end on the opposite side to the end 213 with which the cutting part 22 is formed integrally: hereinafter, referred to as the tail end surface) of the shank part 21, a disk-shaped flange part 23 protruding outwardly in the radial direction is formed. A part of the outer peripheral surface 231 of the disk-shaped flange part 23 is formed to be a flat-surface cutout 232 that has predetermined positional relations with the cutting edges 223. This cutout 232 comes in contact with a side surface 331 of the rotation lock 33 that is received in the cutter holder 31 (i.e. in the below-described rotation lock groove 314) (See FIG. 2(C)), so as to position the cutting edges 223 in relation to the holder set 3 and to prevent rotation of the floating cutter 2 about the axial center O in relation to the holder set 3. The shape of the cutout 232 is not limited to the flat surface shape shown in the figure, and may be any shape that can prevent rotation according to the shape of the rotation lock 33.

Figure 4:
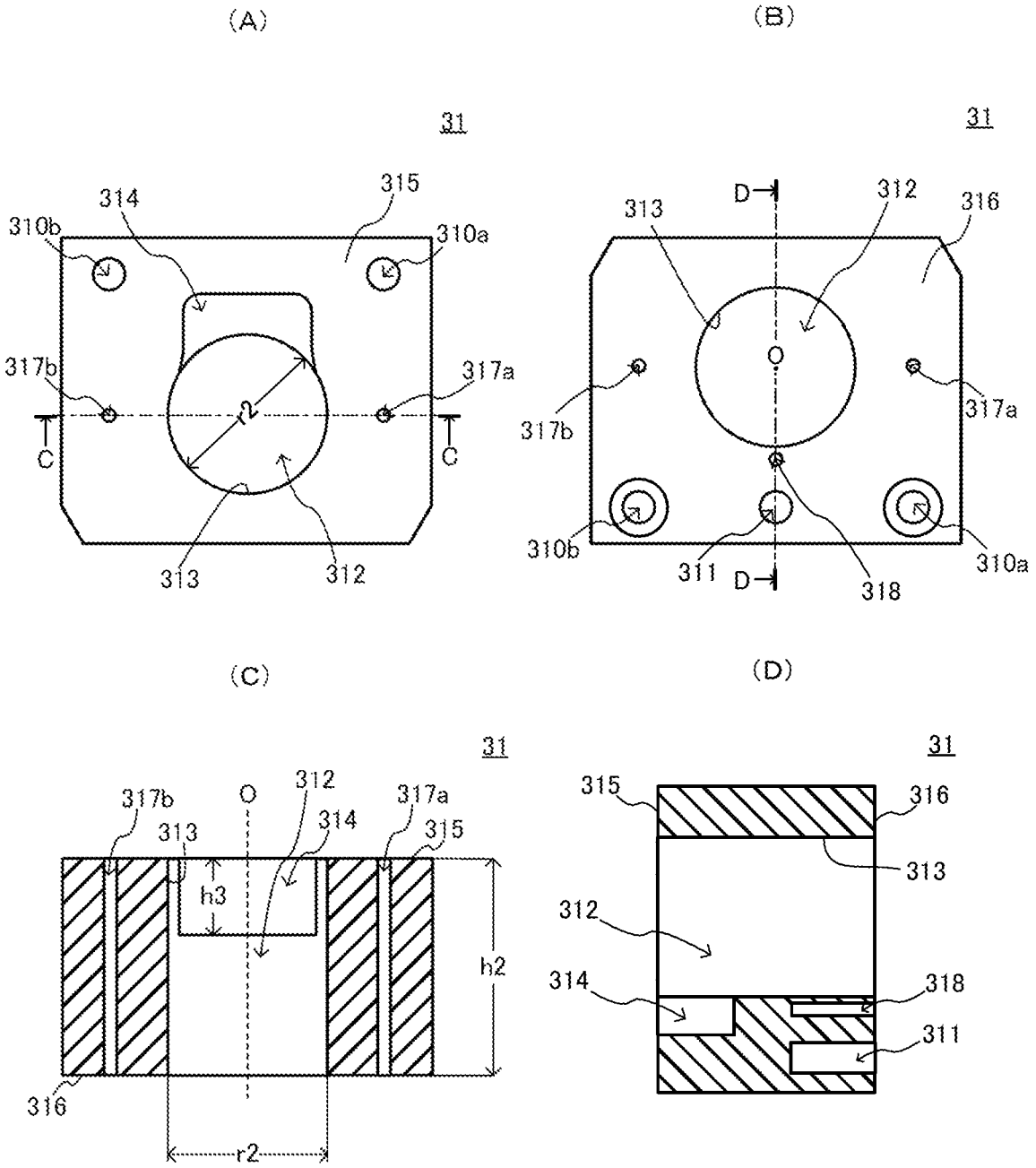
FIGS. 4(A) and 4(B) are respectively a top view and a bottom view of a cutter holder 31.
FIG. 4(C) is a C-C cross-section view of the cutter holder 31 shown in FIG. 4(A)
FIG. 4(D) is a D-D cross-section view of the cutter holder 31 shown in FIG. 4(B)

FIGS. 4(A) and 4(B) are respectively a top view and a bottom view of the cutter holder 31, FIG. 4(C) is a C-C cross-section view of the cutter holder 31 shown in FIG. 4(A), and FIG. 4(D) is a D-D cross-section view of the cutter holder 31 shown in FIG. 4(B).

As shown in the figures, in the cutter holder 31, bolt holes 310*a* and 310*b* for inserting fixing bolts (not shown) for fixing the floating cutter unit 1 to the upper die attachment plate of the trimming press processing device are formed to pass through the upper surface 315 as one end surface and the bottom surface 316 as the other end surface. In addition, a bolt hole 311 for inserting a fixing bolt (not shown) for fixing the guide member 5 to the holder set 3 is formed in the bottom surface 316. Further, a cutter through-hole 312 for inserting the floating cutter 2 in the direction of the axial center O is formed to pass through the upper surface 315 and the bottom surface 316.

Each of the bolt holes 310*a* and 310*b* is formed to be a stepped hole whose diameter is larger on the side of the bottom surface 316 than on the side of the upper surface 315 of the cutter holder 31, so that the head of an inserted fixing bolt is received on the side of the bottom surface 316.

The cutter through-hole 312 has the inner diameter r2 that is larger than the outer diameter (r1 in FIG. 3(A)) of the flange part 23 of the floating cutter 2. The bush 34 for holding the floating cutter 2 movably in the direction of the axial center O is fitted into the inside of the cutter through-hole 312. Further, on the side of one end (on the side of the upper surface 315) of the inner wall surface 313 of the cutter through-hole 312, a rotation lock groove 314 having a concave shape opened on the side of the upper surface 315 is formed, so that the rotation lock 33 is received in the rotation lock groove 314.

Further, in the cutter holder 31, knock holes 317*a* and 317*b* are formed to pass through the upper surface 315 and the bottom surface 316, so as to insert knock pins (not shown) for positioning the floating cutter 2, which is inserted in the bush 34 in the inside of the cutter through-hole 312, in relation to the trimming press processing device. In addition, a knock hole 318 is formed in the bottom surface 316, so as to insert a knock pin (not shown) for positioning the guide member 5 fixed on the bottom surface 316 in relation to the floating cutter 2.

Figure 5:
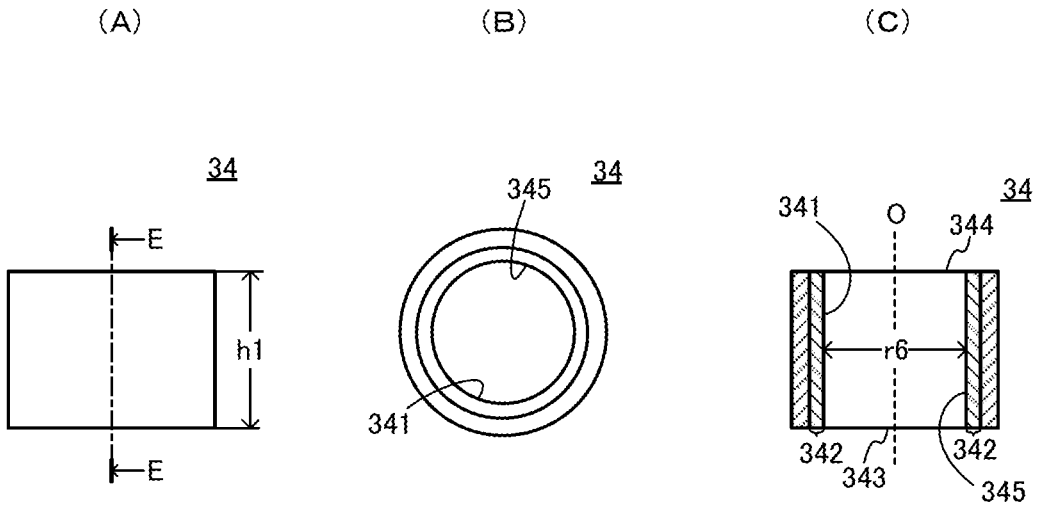
FIGS. 5(A) and 5(B) are respectively a front view and a top view of a bush 34.
FIG. 5(C) is an E-E cross-section view of the bush 34 shown in FIG. 5(A)

FIGS. 5(A) and 5(B) are respectively a front view and a top view of the bush 34, and FIG. 5(C) is an E-E cross-section view of the bush 34 shown in FIG. 5(A).

As shown in the figures, the bush 34 has the length h1 at least shorter than the depth h2 of the cutter through-hole 312 of the cutter holder 31 by the depth h3 of the rotation lock groove 314 (See FIG. 4(C)). The bush 34 is fitted in the cutter through-hole 312 of the cutter holder 34 and fixed at a position where both the end surfaces 343 and 344 of the bush 34 do not protrude from the cutter through-hole 312 of the holder 31 in the direction of the axial center O.

In this state, when the shank part 21 of the floating cutter 2 is inserted into the bush 34, the flange part 23 of the floating cutter 2 abuts against one end surface 344 of the bush 34 within the cutter through-hole 312 of the cutter holder 31 so as to prevent falling of the floating cutter 2 out of the cutter through-hole 312 of the cutter holder 31 (See FIG. 2(C)). At this time, for smooth insertion of the floating cutter 2, a sliding surface 345 on which the outer peripheral surface 211 of the shank part 21 of the floating cutter 2 slides is formed in the inner peripheral surface 341 of the bush 34.

In detail, in the inner peripheral surface 341 of the bush 34, a sliding layer 342 is formed as a sliding part. As this sliding layer 342, for example, a porous sintered alloy layer is used. The porous sintered alloy layer is obtained by dispersing solid lubricant such as graphite into copper ally or the like, sintering this copper alloy or the like, and then subjecting the sintered copper alloy or the like to oil impregnation treatment. As such a bush 34, it is possible to mention, for example, Oiles #2000 produced by Oiles Corporation. Oiles #2000 has dual structure of a metal pipe and a sliding layer formed in the inside of the metal pipe, and is formed by pressing a cylindrical green compact including 4-10% of tin, 10-40% of nickel, 0.5-4% of phosphorus, and 3-10% of graphite by weight percent, and including copper as the balance, into a pipe formed of one of iron, iron alloy, copper, and copper alloy, and by sintering the pipe and the green compact. Instead of the sliding layer 342, the sliding part may be formed for example by embedding solid lubricant such as graphite in the bush 34 such that the embedded solid lubricant is exposed on the inner peripheral surface 341 of the bush 34. As such a bush 34, it is possible to mention Oiles #500 produced by Oiles Corporation.

Here, the outer diameter (r5 in FIG. 3(B)) of the shank part 21 of the floating cutter 2 is finished with zero or plus tolerance from the reference dimension, and the inner diameter (r6 in FIG. 5(C)) of the bush 34 into which the shank part 21 is inserted is finished with zero or minus tolerance from the reference dimension. Although thereby the clearance between the outer diameter r5 of the shank part 21 of the floating cutter 2 and the inner diameter r6 of the bush 34 becomes zero or minus clearance, the shank part 21 of the floating cutter 2 is smoothly inserted into the bush 34 without causing scoring because the bush 34 is provided with the sliding layer 342. Also at the time of scrap dividing processing, smooth movement is realized without causing scoring.

Figure 6:
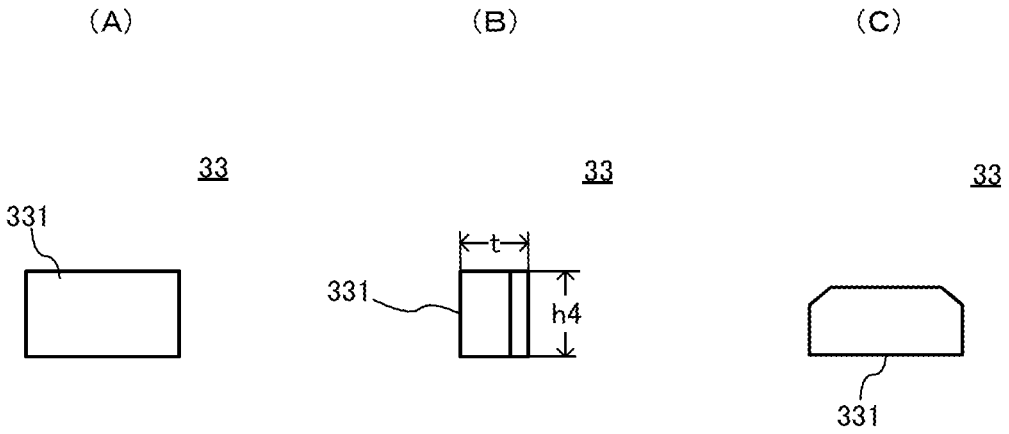
FIGS. 6(A), 6(B), and 6(C) are respectively a front view, a side view, and a top view of a rotation lock 33.

FIGS. 6(A), 6(B), and 6(C) are respectively a front view, a side view, and a top view of the rotation lock 33.

As shown in the figures, the rotation lock 33 has the height h4 shorter than the depth h3 of the rotation lock groove 314 of the cutter holder 31 (See FIG. 4(C)), and is inserted into the rotation lock groove 314 from the side of the upper surface 315 of the cutter holder 31 so as to be received in the rotation lock groove 314. Further, the rotation lock 33 has the thickness t so that, in the state that the rotation lock 33 is received in the rotation lock groove 314, the side surface 331 facing inward in the radial direction comes in contact with the cutout 232 of the flange part 23 of the floating cutter 2 inserted in the cutter through-hole 312 of the cutter holder 31. This prevents rotation of the floating cutter 2 about the axial center O in relation to the holder set 3. Here, in addition to the rotation locking function, the rotation lock 33 may be given a function to assist sliding in the direction of the axial center O by forming at least in the side surface 331 of the rotation lock 33 a sliding surface similar to the sliding surface 345 formed in the inner peripheral surface 341 of the bush 34.

Figure 7:
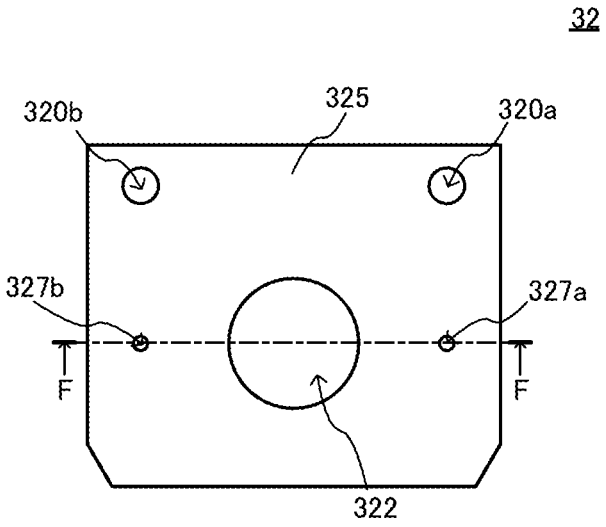
FIG. 7(A) is a top view of a spring holder 32.
FIG. 7(B) is an F-F cross-section view of the spring holder 32 shown in FIG. 7(A)
Figure 7:
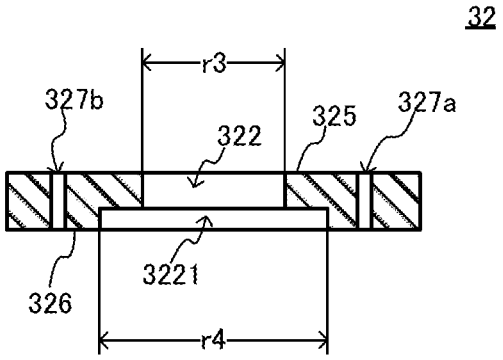

FIG. 7(A) is a top view of the spring holder 32, and FIG. 7(B) is an F-F cross-section view of the spring holder 32 shown in FIG. 7(A).

Figure 8:
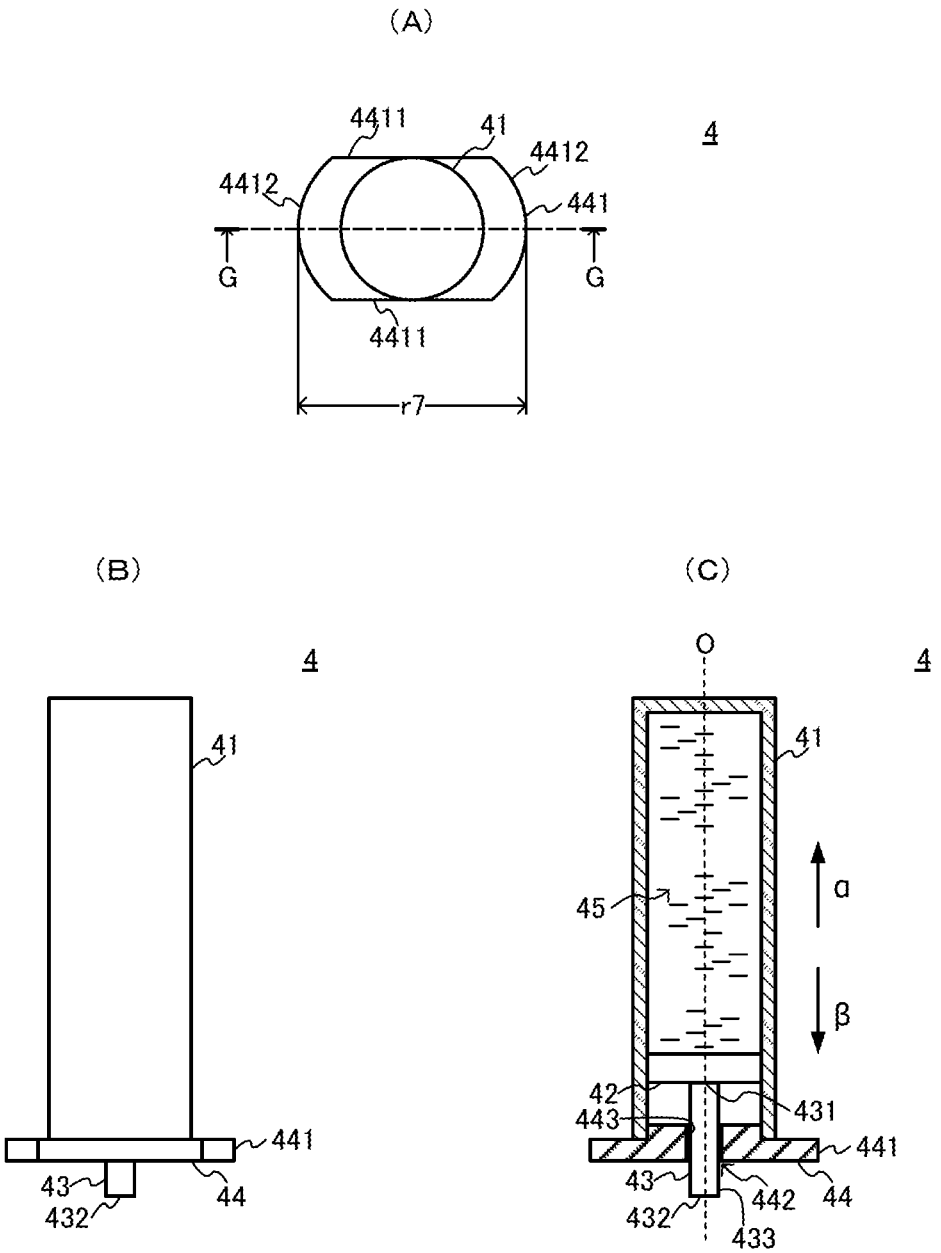
FIGS. 8(A) and 8(B) are respectively a top view and a front view of a spring 4.
FIG. 8(C) is a G-G cross-section view of the spring 4 shown in FIG. 8(A)

As shown in the figures, in the spring holder 32, bolt holes 320*a* and 320*b* are formed so as to connect respectively with the bolt holes 310*a* and 310*b* of the cutter holder 31 in a state that the spring holder 32 is superposed on the upper surface 315 of the cutter holder 31. Into the bolt holes 320*a* and 320*b*, the respective fixing bolts (not shown) that are inserted into the bolt holes 310*a* and 310*b* of the cutter holder 31 are inserted. In a spring through-hole 322, the spring 4 arranged coaxially with the floating cutter 2 inserted in the cutter through-hole 312 of the cutter holder 31 is inserted. This spring through-hole 322 is a stepped hole having a larger diameter on the side of one (back) surface (the surface to be superposed on the upper surface 315 of the cutter holder 31) 326 than on the side of the other (front) surface (the surface on the side of the upper die attachment plate of the trimming press processing device) 325 ($r3<r4$), and receives a flange part 441 (See FIG. 8) of the spring 4 in a large diameter part 3221.

Further, in the spring holder 32, knock holes 327*a* and 327*b* are formed to connect respectively with the knock holes 317*a* and 317*b* of the cutter holder 31 in a state that the spring holder 32 is superposed on the upper surface 315 of the cutter holder 31. Into the knock holes 327*a* and 327*b*, the knock pins (not shown) that are inserted into the knock holes 317*a* and 317*b* of the cutter holder 31 are inserted, respectively.

FIGS. 8(A) and 8(B) are respectively a top view and a front view of the spring 4, and FIG. 8(C) is a G-G cross-section view of the spring 4 shown in FIG. 8(A).

As shown in the figures, the spring 4 comprises: a circular cylinder 41, which is filled with compressible fluid 45 such as silicone oil; a piston 42, which reciprocates in the direction of the axial center O ($\alpha$ direction and $\beta$ direction) within the cylinder 41; a piston rod 43, one end 431 of which is connected to the piston 42 and the other end 432 abuts against the tail end surface 212 of the floating cutter 2; a cover 44, which seals the compressible fluid 45 such as silicone oil within the cylinder 41 and holds the piston rod 43 slidably; and a seal material (not shown) or the like, which is interposed between the outer peripheral surface 433 of the piston rod 43 and the inner peripheral surface 443 of a through-hole 442 of the cover 44.

In the cover 44, the flange part 441 is formed to protrude from the outer periphery. The outer periphery of the flange part 441 is formed by a pair of opposed flat surfaces 4411 and a pair of opposed curved surfaces 4412. The pair of curved surfaces 4412 protrude from the outer periphery of the cover 44, and the distance r7 between the curved surfaces 4412 is larger than the diameter r3 of the spring through-hole 322 of the spring holder 32 (See FIG. 7(B)). Accordingly, the flange part 441 engages with the large diameter part 3221 of the spring holder 32, to prevent falling of the spring 4 out of the spring holder 32.

Owing to the above-described configuration, when force of less than a predetermined value is applied to the floating cutter 2 in the direction (upward direction $\alpha$) from the bottom surface 316 toward the upper surface 315 of the cutter holder 31, movement of the piston 42 in the upward direction $\alpha$ is prevented owing to the resistance of the compressible fluid 45 within the cylinder 41, and therefore the floating cutter 2 does not move in relation to the cutter holder 31. On the other hand, when force of larger than or equal to the predetermined value is applied to the floating cutter 2 in the upward direction $\alpha$, the piston 42 moves in the upward direction $\alpha$ owing to the compressible fluid 45 within the cylinder 41, and therefore the floating cutter 2 moves in the upward direction $\alpha$ in relation to the cutter holder 31.

When the force of larger than or equal to the predetermined value is removed, the floating cutter 2 returns to the initial position Pi (See FIG. 1) owing to the restoring force of the compressible fluid 45. The restoring force of the compressible fluid 45 is set to be larger than the holding force (fixing force owing to the interference range of the bush 34 and the shank part 21 of the floating cutter 2, and the frictional force between the sliding surface 345 of the bush 34 and the outer peripheral surface 211 of the shank part 21 of the floating cutter 2) of the cutter holder 31 for holding the floating cutter 2, and thereby it is possible to return the floating cutter 2 certainly to the initial position Pi.

The present embodiment uses the spring 4 that applies the compressible fluid 45. However, instead of the compressible fluid 45, it is possible to use gas such as nitrogen gas or an elastic body such as a coil spring.

Figure 9:
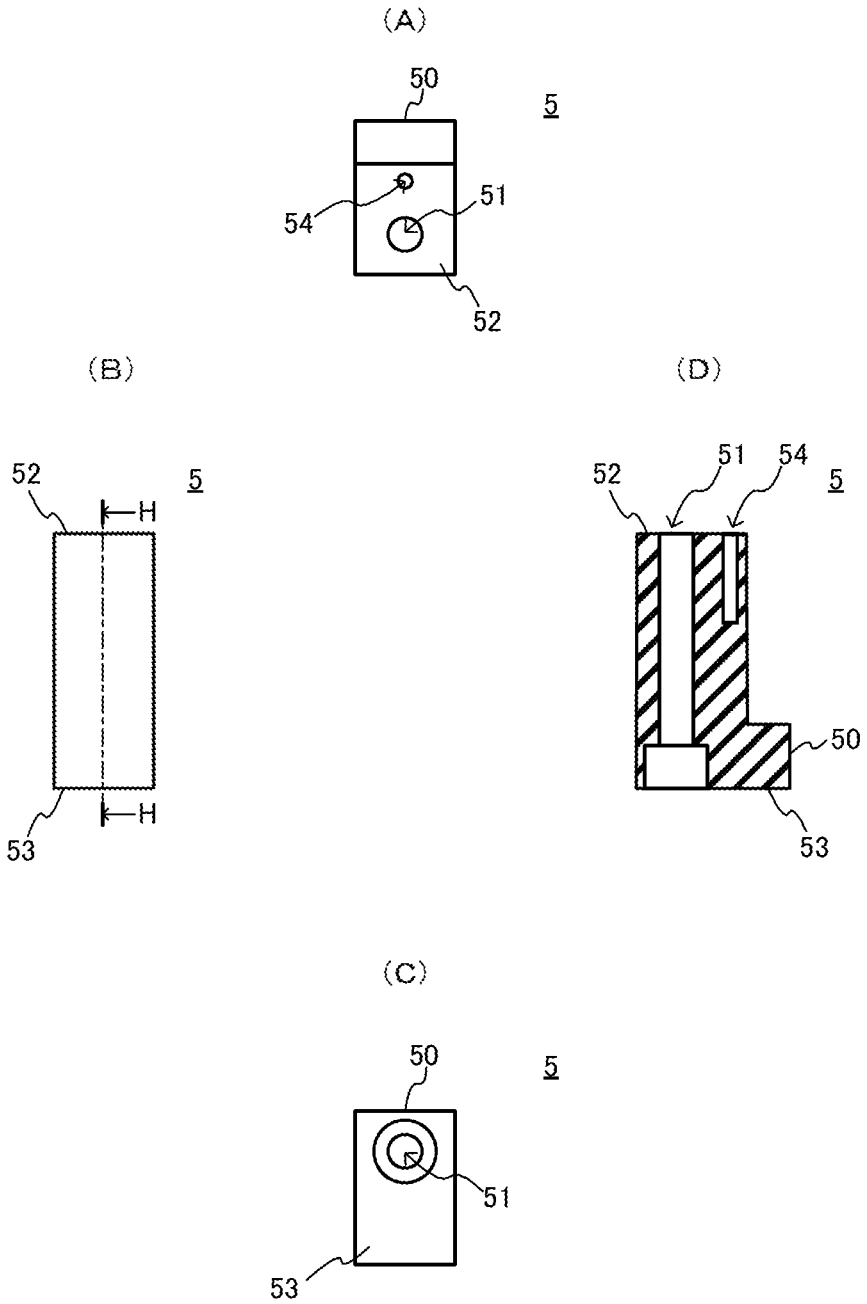
FIGS. 9(A)-9(C) are respectively a top view, a front view, and a bottom view of a guide member 5.
FIG. 9(D) is an H-H cross-section view of the guide member shown in FIG. 9(B)

FIGS. 9(A)-9(C) are respectively a top view, a front view, and a bottom view of the guide member 5, and FIG. 9(D) is an H-H cross-section view of the guide member 5 shown in FIG. 9(B).

Figure 10:
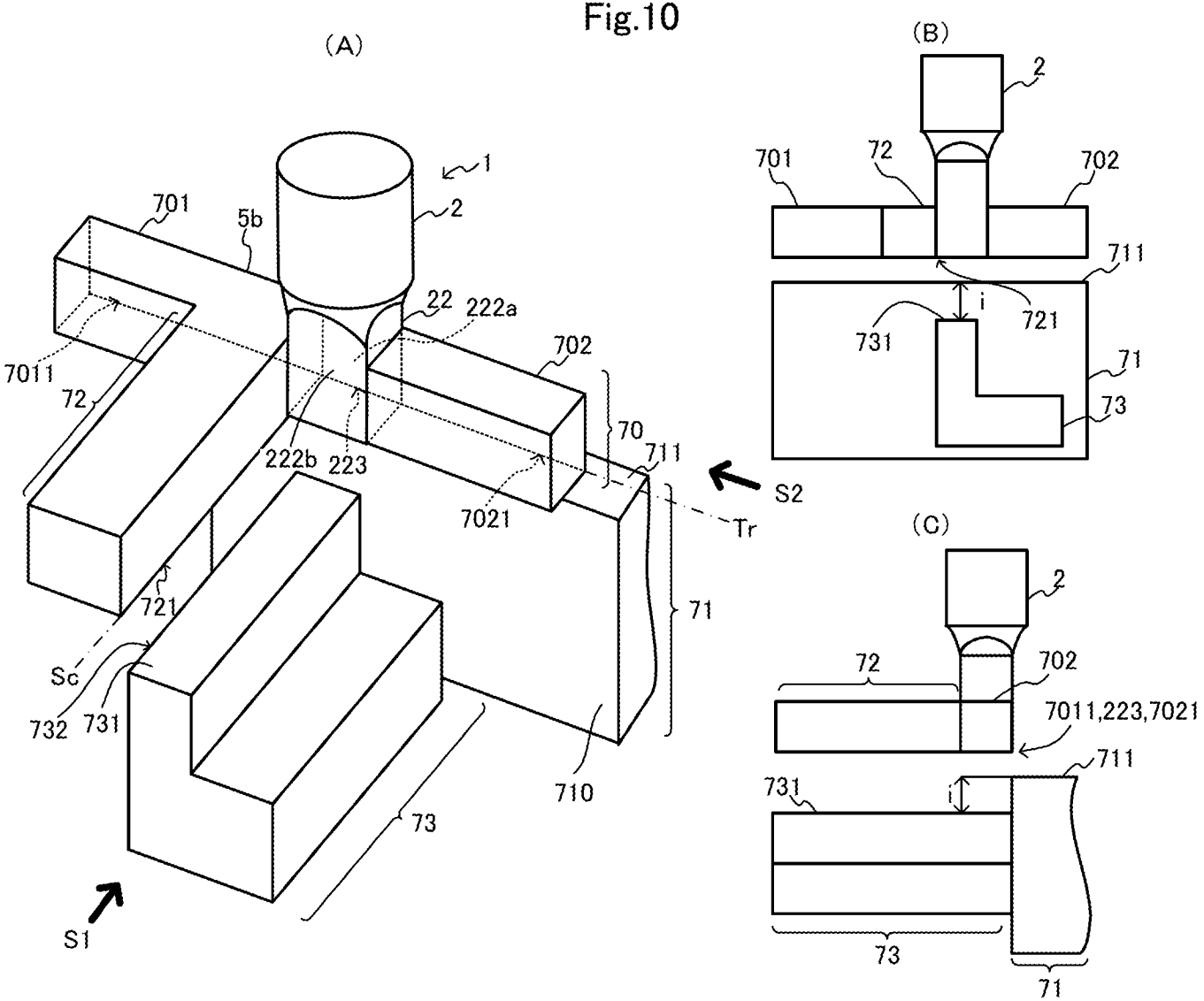
FIG. 10(A) is a perspective view showing a schematic configuration of a die part of a trimming press processing device using the floating cutter unit 1 of the one embodiment of the present invention.
FIGS. 10(B) and 10(C) are views of the trimming press processing device shown in FIG. 10(A) respectively seen in the directions of the arrows S1 and S2.

As shown in the figures, the guide member 5 has a guide surface 50 that guides movement of the floating cutter 2 in the direction of the axial center O by sliding on the cutting surface 222*b* of the floating cutter 2 on the opposite side from the cutting surface 222*a* whose intersection line with the cutting surface 221 of the floating cutter 2 forms a cutting tooth along the trim line Tr together with cutting edges 7011 and 7021 (See FIG. 10).

In the guide member 5, a bolt hole 51, which passes through the upper surface 52 as one end surface and the bottom surface 53 as the other end surface of the guide member 5 is formed. The bolt hole 51 connects with the bolt hole 311 of the cutter holder 31 in a state that the guide member 5 is positioned on the bottom surface 316 of the cutter holder 31 such that the guide surface 50 slides on the cutting surface 222*b* of the floating cutter 2 so as to guide movement of the floating cutter 2 in the direction of the axial center O. The bolt hole 51 is a stepped hole formed in such a way that the diameter of the bolt hole 51 on the side of the bottom surface 53 is larger than the diameter of the bolt hole 51 on the side of the upper surface 52 of the guide member 5, so that the head of an inserted fixing bolt is received on the side of the bottom surface 53.

Further, in the upper surface 51 of the guide member 5, a knock hole 54, which connects with the knock hole 318 of the cutter holder 31, is formed in a state that the guide member 5 is positioned on the bottom surface 316 of the cutter holder 31 such that the guide surface 50 slides on the cutting surface 222*b* of the floating cutter 2 so as to guide movement of the floating cutter 2 in the direction of the axial center O. Into the knock hole 54, a knock pin (not shown) inserted in the knock hole 318 of the cutter holder 31 is inserted.

Next, an example of an assembly procedure of the floating cutter unit 1 of the present embodiment and a fixing procedure to the trimming press processing device will be described.

First, the bush 34 is fitted into and fixed to the cutter through-hole 312 of the cutter holder 31, and the rotation lock 33 is inserted into the rotation lock groove 314 of the cutter holder 31 from the side of the upper surface 315 of the cutter holder 31.

Next, the floating cutter 2 is inserted into the cutter through-hole 312 of the cutter holder 31 from the side of the cutting part 22 while making the cutout 232 of the flange part 23 face toward the side surface 331 of the rotation lock 33. Then the shank part 21 of the floating cutter 2 is inserted into the bush 34 until the flange part 23 of the floating cutter 2 abut against the one end surface 344 of the bush 34 in the inside of the cutter through-hole 312 of the cutter holder 31. At this time, although the clearance between the outer diameter r5 of the shank part 21 of the floating cutter 2 and the inner diameter r6 of the bush 34 is zero or minus clearance as described above, the shank part 21 of the floating cutter 2 is smoothly inserted into the bush 34 without causing scoring owing to the sliding layer 342 of the bush 34. Then, the cutout 232 of the flange part 23 of the floating cutter 2 is brought into contact with the side surface 331 of the rotation lock 33 in the inside of the cutter through-hole 312 of the cutter holder 31.

Next, the spring 4 is placed on the side of the tail end surface 212 of the floating cutter 2 so that the other end 432 of the piston rod 43 comes in contact with the tail end surface 212 of the floating cutter 2.

Then, the spring holder 32 is overlaid on the upper surface 315 of the cutter holder 31 so that the cylinder 41 of the spring 4 is inserted into the spring through-hole 322. Thereby, the spring 4 is positioned in relation to the floating cutter 2 in such a way that the other end 432 of the piston rod 43 abuts against the tail end surface 212 of the floating cutter 2 on the axial center O of the floating cutter 2 (that is to say, the piston rod 43 is positioned coaxially with the floating cutter 2 with respect to the axial center O).

Next, knock pins are inserted into the knock holes 317*a* and 317*b* of the cutter holder 31, so as to expose the respective front ends of the knock pins from the knock holes 327*a* and 327*b* of the spring holder 32. At the same time, a knock pin is inserted into the knock hole 318 of the cutter holder 31, so as to expose the front end of the knock pin from the knock hole 318 of the cutter holder 31.

Then, the front end of the knock pin exposed from the knock hole 318 of the cutter holder 31 is inserted into the knock hole 54 of the guide member 5 from the side of the upper surface 52 of the guide member 5 to place the guide member 5 on the bottom surface 316 of the cutter holder 31, so that the guide surface 50 can slide on the cutting surface 222*b* of the floating cutter 2. Thereby, the guide member 5 is positioned in relation to the floating cutter 2 held in the holder set 3.

Next, after the guide member 5 is positioned in relation to the floating cutter 2 held in the holder set 3, a fixing bolt is inserted into the bolt hole 51 of the guide member 5, and screwed into the bolt hole 311 of the cutter holder 31. Thereby, the guide member 5 is fixed to the holder set 3.

Then, the respective front ends of the knock pins exposed from the knock holes 327*a* and 327*b* of the spring holder 32 are inserted into the corresponding knock holes provided in the upper die attachment plate of the trimming press processing device. Thereby, the floating cutter 2 held in the holder set 3 is positioned in relation to the trimming press processing device.

When the floating cutter 2 held in the holder set 3 is positioned in relation to the trimming press processing device in the above-described way, fixing bolts are respectively inserted into the bolt holes 310*a* and 310*b* of the cutter holder 31, so as to expose threaded parts of the fixing bolts from the bolt holes 320*a* and 320*b* of the spring holder 32 via the bolt holes 310*a* and 310*b* of the cutter holder 31 respectively. The exposed threaded parts of the fixing bolts are respectively screwed into screw holes provided in the upper die attachment plate of the trimming press processing device. Thereby, the floating cutter unit 1 is mounted on the trimming press processing device.

Next, trimming press processing by the trimming press processing device using the floating cutter unit 1 of the present embodiment will be described.

FIG. 10(A) is a perspective view showing a schematic configuration of a die part of the trimming press processing device using the floating cutter unit 1 of the present embodiment, and FIGS. 10(B) and 10(C) are views of the trimming press processing device shown in FIG. 10(A) respectively seen in the directions of the arrows S1 and S2.

As shown in the figures, the trimming press processing device comprises: trimming press upper and lower dies 70 and 71, which cut off a scrap other than the product part from a plate material along the trim line Tr; scrap cutting press upper and lower dies 72 and 73, which further divide the cut-off scrap along a scrap cut line Sc; the upper die attachment plate (not shown), to which the trimming press upper die 70 and the scrap cutting press upper die 72 are fixed; and a ram (not shown), which makes the trimming press upper die 70 and the scrap cutting press upper die 72 (the upper die attachment plate) move up and down in relation to the trimming press lower die 71 and the scrap cutting press lower die 73.

The trimming press upper die 70 comprises: a plurality of main trimming press upper dies 701 and 702, which move up and down in relation to the trimming press lower die 71; and the floating cutter unit 1, which moves up and down together with the main trimming press upper dies 701 and 702.

The floating cutter unit 1 is placed between the main trimming press upper dies 701 and 702. Thereby, the cutting edge 223 of the cutting part 22 (the intersection line of the cutting surface 221 and the cutting surface 222*a*) opposed to the trimming press lower die 71 forms the cutting tooth along the trim line Tr together with the respective cutting edges 7011 and 7021 of the main trimming press upper dies 701 and 702.

An upper cutting surface 731 of the scrap cutting press lower die 73 is positioned below an upper cutting surface 711 of the trimming press lower die 71, and there is a distance i larger than the plate thickness of the plate material between these upper cutting surfaces 731 and 711.

Although for the sake of simplicity FIG. 10 shows a case of two main trimming press upper dies 701 and 702 and one floating cutter unit 1, a suitably-determined number of main trimming press upper dies and a suitably-determined number of floating cutter units 1 are used in practice.

FIGS. 11(A)-11(D) are views for explaining trimming press processing by the trimming press processing device that uses the floating cutter unit 1 of the present embodiment. Here, FIGS. 11(A) and 11(B) correspond to FIG. 10(C) seen in the direction of the arrow S2, and FIGS. 11(C) and 11(D) correspond to FIG. 10(B) seen in the direction of the arrow S1.

Figure 11:
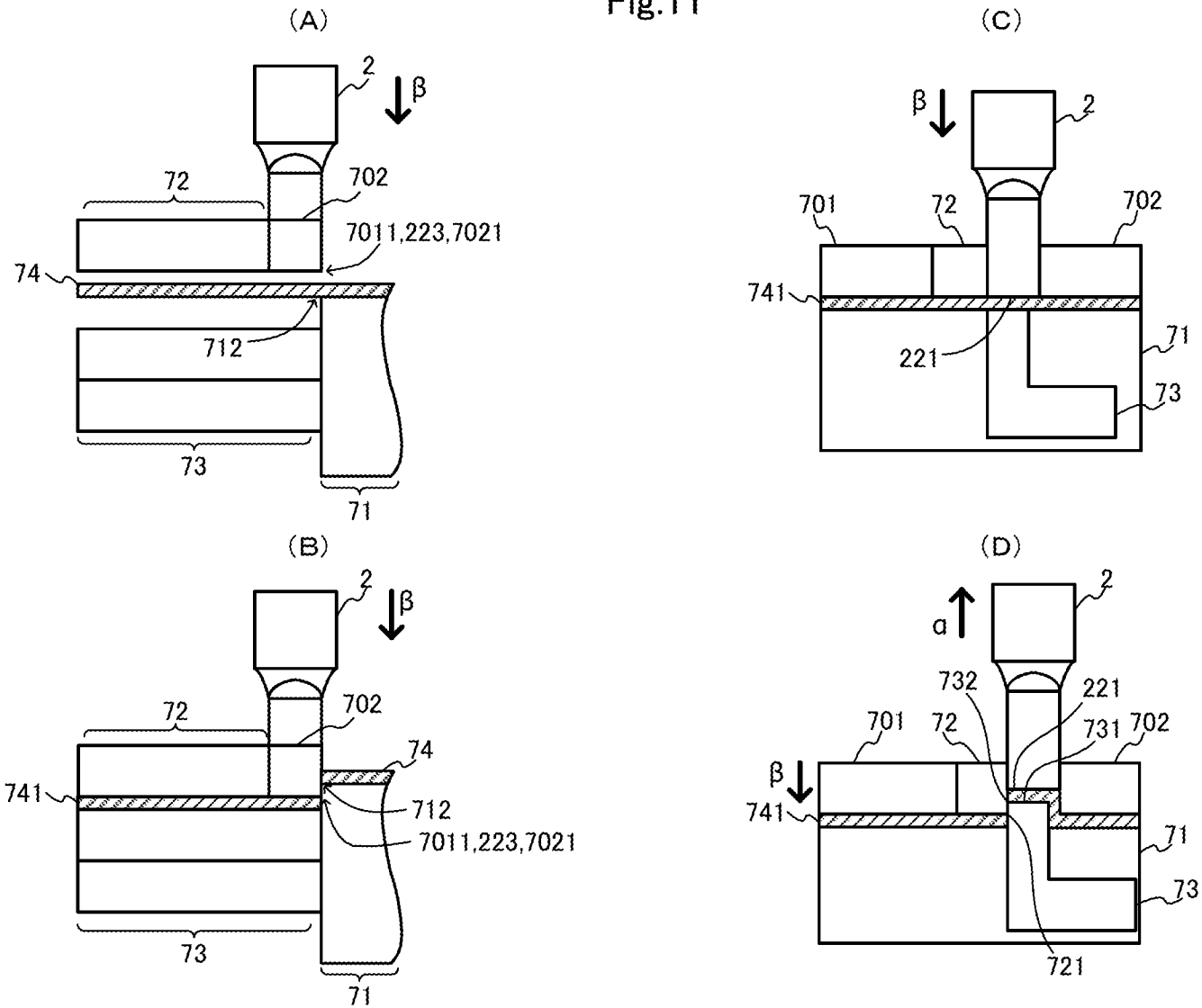
FIGS. 11(A)-11(D) are views for explaining trimming press processing by the trimming press processing device that uses the floating cutter unit 1 of the one embodiment of the present invention.

As shown in FIG. 11(A), when the plate material 74 is set on the trimming press lower die 71, the main trimming press upper dies 701 and 702, the floating cutter unit 1, and the scrap cutting press upper die 72 are driven by the ram so as to start moving down in the direction β toward the trimming press lower die 71.

Then, as shown in FIG. 11(B), a scrap 741 other than the product part is cut off from the plate material 74 along the trim line Tr by the cutting edges 7011 and 7021 of the main trimming press upper dies 701 and 702, and the cutting edge 223 of the floating cutter 2, and the cutting edge 712 of the trimming press lower die 71. At this time, since the piston 42 is prevented from moving by the resistance of the compressible fluid 45 in the cylinder 41, the floating cutter 2 does not move in relation to the cutter holder 31. Thereby, the cutting edge 223 of the floating cutter 2 moves synchronously with the cutting edges 7011 and 7021 of the main trimming press upper dies 701 and 702.

Thereafter, as shown in FIG. 11(C), the main trimming press upper dies 701 and 702, the floating cutter unit 1, and the scrap cutting press upper die 72 continue moving down in the direction β. Thereby, when the cutting surface 221 at the front end of the floating cutter 2 is pressed against the scrap cutting press lower die 73 via the scrap 741, the piston 42 moves in the upward direction α owing to the compressible fluid 45 in the cylinder 41 as shown in FIG. 11(D). Then the floating cutter 2 moves upward in the direction α in relation to the cutter holder 31. On the other hand, the scrap cutting press upper die 72 continues moving down synchronously with the main trimming press upper dies 701 and 702. Thereby, the scrap 741 is divided by the cutting edge 721 of the scrap cutting press upper die 72 and the cutting edge 732 of the scrap cutting press lower die 73 along the scrap cut line Sc.

Hereinabove, one embodiment of the present invention has been described.

In the floating cutter unit 1 of the present embodiment, since the guide member 5 is fixed to the holder set 3 that holds floating cutter 2 movably in the direction of the axial center O, it is possible to increase the positional accuracy of the guide member 5 in relation to the floating cutter 2. And, itis possible to guide movement of the floating cutter 2 in the direction of the axial center O near by the cutting surface 221 as the front end of the floating cutter 2, which forms the cutting tooth along the trim line Tr together with the main trimming press upper dies 701 and 702.

Thus, according to the present embodiment, it is possible to move the floating cutter unit 1 up and down with a high degree of accuracy in relation to the main trimming press upper dies 701 and 702 and thereby to increase the positional accuracy of the floating cutter unit 1 in relation to the main trimming press upper dies 701 and 702.

Further, in the present embodiment, the guide surface 50 of the guide member 5 slides on the cutting surface 222*b* of the floating cutter 2 on the opposite side of the cutting surface 222*a* that forms the cutting tooth along the trim line Tr together with the cutting surface 221, so as to guide movement of the floating cutter 2 in the direction of the axial center O. Accordingly, it is possible to prevent the floating cutter 2 from being pressed and inclined toward the side of the cutting surface 222*b* owing to contact of the cutting surface 222*a* with the cutting surface 710 (See FIG. 10) of the main trimming press lower die 71. Therefore, it is possible to move the floating cutter unit 1 up and down with a higher degree of accuracy in relation to the main trimming press upper dies 701 and 702.

The present invention is not limited to the above-described embodiment, and can be varied in many ways within the scope of the invention.

For example, the above embodiment has been described taking an example in which the guide member 5 slides on the cutting surface 222*b* on the opposite side of the cutting surface 222*a* that forms the cutting tooth along the trim line Tr together with the cutting surface 221, so as to guide movement of the floating cutter 2 in the direction of the axial center O. The present invention, however, is not limited to this. Instead of the guide member 5 or in addition to the guide member 5, it is possible to use guide members that slide on the cutting surfaces 222*c*, 222*d* on both sides of the cutting surface 222*a* that forms the cutting tooth along the trim line Tr together with the cutting surface 221, so as to guide movement of the floating cutter 2 in the direction of the axial center O.

Figure 12:
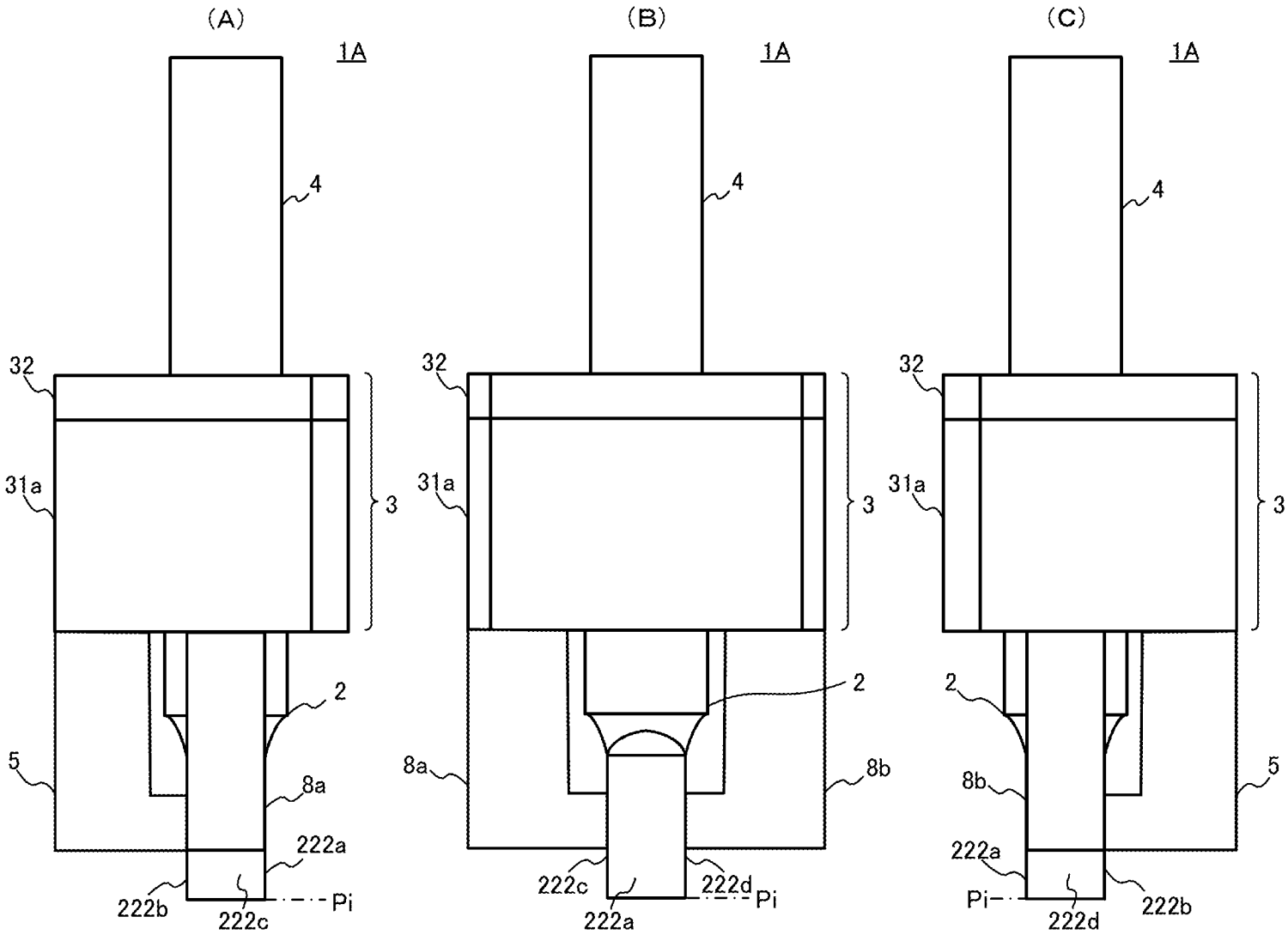
FIGS. 12(A), 12(B), and 12(C) are respectively a left side view, a front view, and a right side view of a floating cutter unit 1A as a variation of the one embodiment of the present invention.
Figure 13:
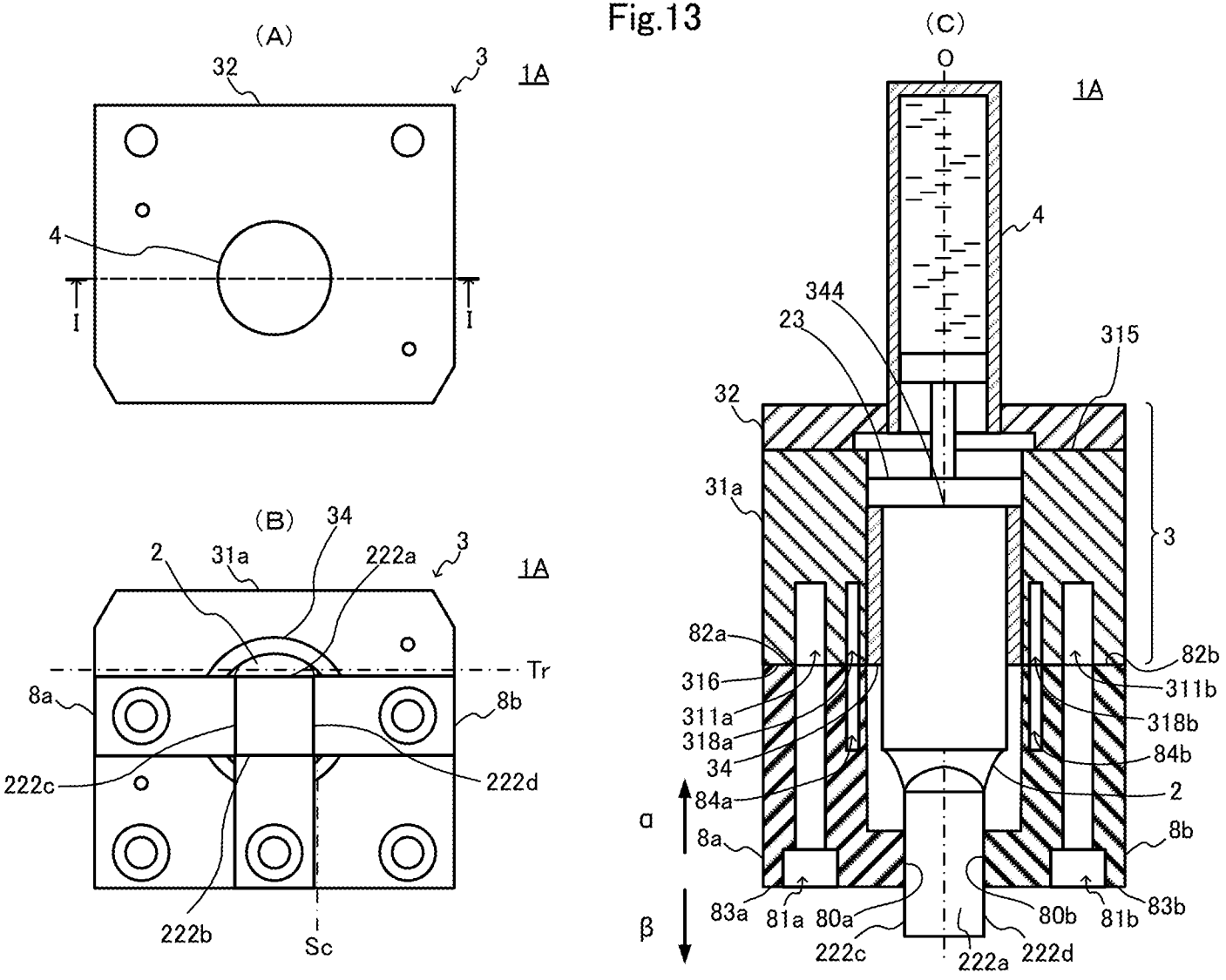
FIGS. 13(A) and 13(B) are respectively a top view and a bottom view of the floating cutter unit 1A of the variation of the one embodiment of the present invention.
FIG. 13(C) is an I-I cross-section view of the floating cutter unit 1A shown in FIG. 13(A).

FIGS. 12(A), 12(B), and 12(C) are respectively a left side view, a front view, and a right side view of a floating cutter unit 1A as a variation of the present embodiment. Further, FIGS. 13(A) and 13(B) are respectively a top view and a bottom view of the floating cutter unit 1A of the variation of the present embodiment, and FIG. 13(C) is an I-I cross-section view of the floating cutter unit 1A shown in FIG. 13(A).

As shown in the figures, the floating cutter unit 1A as a variation of the present embodiment is different from the floating cutter unit 1 in that a cutter holder 31*a* is used instead of the cutter holder 31 and guide members 8*a* and 8*b* are added. The other configuration is similar to the floating cutter unit 1 of the present embodiment.

The cutter holder 31*a* is different from the cutter holder 31 in that bolt holes 311*a* and 311*b* are formed in the bottom surface 316 in order to insert fixing bolts (not shown) for fixing the guide members 8*a* and 8*b* to the holder set 3, and knock holes 318*a* and 318*b* are formed in the bottom surface 316 in order to insert knock pins (not shown) for positioning the guide members 8*a* and 8*b* fixed on the bottom surface 316 in relation to the floating cutter 2. In the other points, the cutter holder 31*a* is similar to the cutter holder 31.

The guide members 8*a* and 8*b* have, respectively, guide surfaces 80*a* and 80*b* that are in sliding contact with the cutting surfaces 222*c* and 222*d* on both sides of the cutting surface 222*a* that forms the cutting tooth along the trim line Tr together with the cutting surface 221, so as to guide movement of the floating cutter 2 in the direction of the axial center O.

In the guide members 8*a* and 8*b*, bolt holes 81*a* and 81*b* are formed to pass through respectively the upper surfaces 82*a* and 82*b* as end surfaces of the guide members 8*a* and 8*b* and the bottom surfaces 83*a* and 83*b* as the other end surfaces of the guide members 8*a* and 8*b*. The bolt holes 81*a* and 81*b* connect respectively to the bolt holes 311*a* and 311*b* of the cutter holder 31*a* in a state that the guide members 8*a* and 8*b* are positioned on the bottom surface 316 of the cutter holder 31*a* such that the guide surfaces 80*a* and 80*b* slide on the respective cutting surfaces 222*c* and 222*d* of the floating cutter 2 so as to guide movement of the floating cutter 2 in the direction of the axial center O. The bolt holes 81*a* and 81*b* are stepped holes having a larger diameter on the side of the bottom surfaces 83*a* and 83*b* than the diameter on the side of the upper surfaces 82*a* and 82*b* of the guide members 8*a* and 8*b*, so that the heads of the inserted fixing bolts are received on the side of the bottom surfaces 83*a* and 83*b*, respectively.

Further, in the upper surfaces 82*a* and 82*b* of the guide members 8*a* and 8*b*, knock holes 84*a* and 84*b* are formed. The knock holes 84*a* and 84*b* connect respectively to knock holes 318*a* and 318*b* of the cutter holder 31*a* in the state that the guide members 8*a* and 8*b* are positioned on the bottom surface 316 of the cutter holder 31*a* such that the guide surfaces 80*a* and 80*b* slide on the respective cutting surfaces 222*c* and 222*d* of the floating cutter 2 so as to guide movement of the floating cutter 2 in the direction of the axial center O. Into the knock holes 84*a* and 84*b*, the knock pins (not shown) inserted in the knock holes 318*a* and 318*b* of the cutter holder 31*a* are inserted, respectively.

According to the floating cutter unit 1A of the above-described configuration, movement of the floating cutter 2 in the direction of the axial center O is guided by the guide surface 50 of the guide member 5, which slides on the cutting surface 222*b* on the opposite side from the cutting surface 222*a* that forms the cutting tooth along the trim line Tr together with the cutting surface 221. In addition, the guide surfaces 80*a* and 80*b* of the guide members 8*a* and 8*b* slide respectively on the cutting surfaces 222*c* and 222*d* on both sides of the cutting surface 222*a* that forms the cutting tooth along the trim line Tr together with the cutting surface 221, so as to guide the movement of the floating cutter 2 in the direction of the axial center O. Thereby, it is possible to move the floating cutter unit 1 up and down with a higher degree of accuracy in relation to the main trimming press upper dies 701 and 702.

Further, in the floating cutter unit 1A of the variation of the present embodiment, it is possible to form trim cutters that are positioned on both sides of the floating cutter 2 along the trim line Tr, integrally with the guide members 8*a* and 8*b*. The trim cutters form the cutting tooth along the trim line Tr together with the cutting edge 223 of the cutting part 22 of the floating cutter 2 and the cutting edges 7011 and 7021 of the main trimming press upper dies 701 and 702.

By this arrangement, it is possible to increase the positional accuracy of the trim cutters positioned on both sides of the floating cutter 2 along the trim line Tr in relation to the floating cutter 2. Accordingly, gaps between the trim cutters and the floating cutter 2 are not affected by errors of fixing positions of the main trimming press upper dies 701 and 702 and the floating cutter unit 2 to the trimming press processing device. Accordingly, the gaps between the trim cutters and the floating cutter 2 can be set with a high degree of accuracy (including a zero gap). Further, since the trim cutters are formed integrally with the guide members 8*a* and 8*b* fixed to the holder set 3, the trim cutters do not move in the direction of the axial center O in relation to the main trimming press upper dies 701 and 702, and thereby galling between the trim cutters and the main trimming press upper dies 701 and 702 does not occur. Thus, it is possible to finish the plate material 74 beautifully along the trim line Tr while preventing galling between the trim cutters and the main trimming press upper dies 701 and 702.

Further, in the floating cutter unit 1A of the variation of the present embodiment, it is possible to form, integrally with the guide member 8*b*, a scrap cutter that forms a cutting tooth along the scrap cut line Sc together with the cutting edge 721 of the scrap cutting press upper die 72.

REFERENCE SIGNS LIST

1, 1A: floating cutter unit; 2: floating cutter; 3: holder set; 4: spring; 5, 8*a*, 8*b*: guide member; 21: shank part of the floating cutter 2; 22: cutting part of the floating cutter 2; 23: flange part of the floating cutter 2; 31, 31*a*: cutter holder; 32: spring holder; 33: rotation lock; 34: bush; 41: cylinder; 42: piston; 43: piston rod; 44: cover; 45: compressible fluid; 50, 80*a*, 80*b*: guide surface; 51, 81*a*, 81*b*, 310*a*, 310*b*, 311, 311*a*, 311*b*, 320*a*, 320*b*: bolt hole; 52, 82*a*, 82*b*: upper surface of the guide member 5, 8*a*, 8*b*; 53, 83*a*, 83*b*: bottom surface of the guide member 5, 8*a*, 8*b*; 54, 84*a*, 84*b*, 317*a*, 317*b*, 318, 318*a*, 318*b*, 327*a*, 327*b*: knock hole; 70: trimming press upper die; 71: trimming press lower die; 72: scrap cutting press upper die; 73: scrap cutting press lower die; 211: outer peripheral surface of the shank part 21; 212: end (tail end surface) of the floating cutter 2; 213: end of the shank part 21; 221, 222*a*-222*d*: cutting surface of the floating cutter 2; 223: cutting edge of the floating cutter 2; 231: outer peripheral surface of the flange part 23; 232: cutout of the flange part 23; 312: cutter through-hole; 313: inner wall surface of the cutter through-hole 312; 314: rotation lock groove of the holder 31; 315: upper surface of the holder 31; 316: bottom surface of the holder 31; 322: spring through-hole; 325: surface of the spring holder 32; 326: back surface of the spring holder 32; 331: side surface of the rotation lock 33; 341: inner peripheral surface of the bush 34; 342: sliding layer of the bush 34; 343, 344: end surface of the bush 34; 345: sliding surface of the bush 34; 431, 432: end of the piston rod 43; 433: outer peripheral surface of the piston rod 43; 441: flange part of the cover 44; 442: through-hole of the cover 44; 443: inner peripheral surface of the through-hole 442; 701, 702: main trimming press upper die; 711: upper cutting surface of the trimming press lower die 71; 721: cutting edge of the scrap cutting press upper die 72; 731: upper cutting surface of the scrap cutting press lower die 73; 732: cutting edge of the scrap cutting press lower die 73; and 7011, 7021: cutting edge of the main trimming press upper die 701, 702.

The invention claimed is:

1. A floating cutter unit for use with a trimming press processing device, the floating cutter unit comprising:

a floating cutter having a first side surface, a second side surface, a tail end surface above the first side surface and the second side surface, and a cutting edge at a bottom edge of the first side surface, the first side surface and the second side surface being on opposite sides of the floating cutter offset from and extending in parallel to a central axis of the floating cutter so that the central axis of the floating cutter extends between the first side surface and the second side surface;

a holder set configured to hold the floating cutter and allow the floating cutter to move in a direction of the central axis of the floating cutter;

a spring in contact with the tail end surface of the floating cutter, the spring being configured to apply a reaction force to the floating cutter;

a first guide member fixed to the holder set, the first guide member comprising a first guide surface that is configured to guide a movement of the floating cutter in the direction of the central axis by engaging the second side surface of the floating cutter so that the second side surface of the floating cutter slides along the first guide surface;

a plurality of intermediate side surfaces that extend from the first side surface to the second side surface; and a plurality of supplemental guide members, each supplemental guide member comprising a supplemental guide surface configured to guide the movement of the floating cutter in the direction of the central axis by engaging a respective one of the intermediate side surfaces so that the respective one of the intermediate side surfaces slides along the supplemental guide surface.

2. The floating cutter unit according to claim 1, further comprising:

a plurality of trim cutters formed integrally with the plurality of supplemental guide members and extending along a trim line at which a scrap is cut off from a plate material.

3. The floating cutter unit according to claim 1, further comprising:

a scrap cutter formed integrally with one of the supplemental guide members and configured to extend along a scrap cut line at which a scrap is divided upon being cut off from a plate material.

4. The floating cutter unit according to claim 2, further comprising:

a scrap cutter formed integrally with one of the supplemental guide members and configured to extend along a scrap cut line at which the scrap is divided upon being cut off from the plate material.

5. The floating cutter unit according to claim 1, wherein the first guide surface is offset from and extends parallel to the central axis of the floating cutter so that the second side surface of the floating cutter is between the central axis of the floating cutter and the first guide surface.

6. A trimming press processing device, comprising:

a trimming press lower die;

a main trimming press upper die configured to move toward the trimming press lower die and cut a plate material between the main trimming press upper die and the trimming press lower die along a trim line;

a floating cutter unit comprising:

a floating cutter having a first side surface, a second side surface, a tail end surface above the first side surface and the second side surface, and a cutting edge at a bottom edge of the first side surface, the first side surface and the second side surface being on opposite sides of the floating cutter offset from and extending in parallel to a central axis of the floating cutter so that the central axis of the floating cutter extends between the first side surface and the second side surface;

a holder set configured to hold the floating cutter and allow the floating cutter to move in a direction of the central axis of the floating cutter;

a spring in contact with the tail end surface of the floating cutter, the spring being configured to apply a reaction force to the floating cutter; and a first guide member fixed to the holder set, the first guide member comprising a first guide surface that is configured to guide a movement of the floating cutter in the direction of the central axis by engaging the second side surface of the floating cutter so that the second side surface of the floating cutter slides along the first guide surface;

a scrap cutting press lower die, which is positioned with a space from a cutting edge of the trimming press lower die at a distance larger than a plate thickness of the plate material in a direction in which the main trimming press upper die moves; and a scrap cutting press upper die, configured to move together with the main trimming press upper die and divide the scrap along a scrap cut line between the scrap cutting press upper die and the scrap cutting press lower die, wherein the floating cutter unit is configured to 1) move together with the main trimming press upper die toward the trimming press lower die, 2) cut the plate material between the trimming press lower die and the floating cutter unit, and 3) cut off, together with the main trimming press upper die, a scrap other than a product part from the plate material, and wherein the floating cutter unit is configured so that when the floating cutter that has cut off the scrap is pressed against the scrap cutting lower die, the floating cutter is moved relative in a reverse direction to the direction in which the main trimming press upper die is moved against to the holder set by compression of the spring.

7. The trimming press processing device according to claim 6, wherein the cutting edge of the floating cutter is configured to extend along the trim line.

* * * * *